US008101547B2

(12) United States Patent
Iwasaki et al.

(10) Patent No.: US 8,101,547 B2
(45) Date of Patent: Jan. 24, 2012

(54) TRANSPARENT THERMAL RECORDING MEDIUM

(75) Inventors: Nobuyuki Iwasaki, Amagasaki (JP); Kenji Muto, Amagasaki (JP); Masaharu Nojima, Amagasaki (JP)

(73) Assignee: Oji Paper Co., Ltd., Tokyo (JP)

( * ) Notice: Subject to any disclaimer, the term of this patent is extended or adjusted under 35 U.S.C. 154(b) by 1018 days.

(21) Appl. No.: 11/990,264

(22) PCT Filed: Aug. 24, 2006

(86) PCT No.: PCT/JP2006/316650

§ 371 (c)(1),
(2), (4) Date: Feb. 11, 2008

(87) PCT Pub. No.: WO2007/023921

PCT Pub. Date: Mar. 1, 2007

(65) Prior Publication Data

US 2009/0227449 A1 Sep. 10, 2009

(30) Foreign Application Priority Data

Aug. 25, 2005 (JP) ..... 2005-243536
Jul. 20, 2006 (JP) ..... 2006-197619

(51) Int. Cl.
*B41M 5/42* (2006.01)

(52) U.S. Cl. ..... 503/226; 503/200

(58) Field of Classification Search ..... None
See application file for complete search history.

(56) References Cited

U.S. PATENT DOCUMENTS

| | | | | |
|---|---|---|---|---|
| 5,547,914 | A * | 8/1996 | De Meutter et al. | 503/210 |
| 7,709,416 | B2 * | 5/2010 | Iida et al. | 503/207 |

FOREIGN PATENT DOCUMENTS

| | | | |
|---|---|---|---|
| EP | 0 707 978 | | 4/1996 |
| EP | 1 538 005 | A1 | 6/2005 |
| JO | HEI 08-276664 | A | 10/1996 |
| JP | HEI 02-070483 | A | 3/1990 |
| JP | 2000-118133 | A | 4/2000 |
| JP | 2000-118138 | A | 4/2000 |
| JP | 2000-238432 | A | 9/2000 |
| JP | 2000-355165 | A | 12/2000 |
| JP | 2002-086911 | A | 3/2002 |
| JP | 2003-251936 | A | 9/2003 |
| JP | 2006-142786 | A | 6/2006 |
| WO | 2004/024460 | A1 | 3/2004 |

* cited by examiner

*Primary Examiner* — Bruce H Hess
(74) *Attorney, Agent, or Firm* — Kubovcik & Kubovcik

(57) ABSTRACT

A transparent heat-sensitive recording material of the invention comprises (a) a transparent support; (b) a heat-sensitive recording layer containing a leuco dye and a developer and formed on the transparent support; and (c) a protective layer comprising as main components a pigment and a binder and formed on the heat-sensitive recording layer; wherein the pigment contained in the protective layer is (i) calcined kaolin and at least one main pigment selected from the group consisting of kaolin and aluminum hydroxide, or (ii) calcined kaolin, a third pigment, and at least one main pigment selected from the group consisting of kaolin and aluminum hydroxide; and the calcined kaolin is present in a proportion of 0.3 to 5 mass % relative to the protective layer.

16 Claims, No Drawings

TRANSPARENT THERMAL RECORDING MEDIUM

This application is a 371 of international application PCT/JP2006/316650 filed Aug. 24, 2006, which and 2006-197619 claims priority based on Japanese patent application Nos. 2005-243536 filed Aug. 25, 2005, and Jul. 20, 2006, respectively, each of which is incorporated herein by reference.

TECHNICAL FIELD

The present invention relates to a transparent heat-sensitive recording material using a color-forming reaction between a leuco dye and a developer, in particular, to a transparent heat-sensitive recording material for recording with high energy.

BACKGROUND ART

Heat-sensitive recording materials using a color-forming reaction between a leuco dye and a developer are relatively inexpensive, and the recording apparatuses are compact and easily maintained. Therefore, heat-sensitive recording materials are used not only as recording media for facsimiles, word processors, a variety of computers and the like, but also as recording media for medical instruments for ultrasonic diagnoses, X-ray image diagnoses, NMR (MRI) tomographic image diagnoses, etc.

When such heat-sensitive recording materials are used as recording media for medical diagnoses, an extremely slight density difference in an image is taken as information and used for diagnosis, and therefore image failures such as density unevenness, and omission of pixels (dots) generated during recording should be reduced as much as possible. Generally, a schaukasten is used for diagnoses with medical diagnosis images. Therefore, surroundings (background) of human body images, etc., which are diagnostic objects, are required to have a high black color density so as to block the light from a schaukasten and to prevent unnecessary light from blinding a diagnosing person's (doctor's) eyes. For these reasons, thermal printers used for imaging diagnoses are designed such that the energy width necessary to obtain a saturated transmission density ($D_{T\text{-}max}$), i.e., the dynamic range, is wide so as to suppress density unevenness problems, etc. that are caused by the slight heat conduction differences between heating resistors in the thermal head, and that recording media are made to color at a high saturated transmission density. Therefore, compared to ordinary facsimiles, label printers, etc., thermal printers used for imaging diagnoses have a longer thermal-head-heating time (pulse width) during recording, and an extremely high amount of thermal energy is applied during recording. Therefore, compared to heat-sensitive recording materials used for facsimiles and label printers, heat-sensitive recording materials used for medical diagnoses have disadvantages in terms of residue adhesion to a thermal head and thermal-head wear.

In order to reduce residue adhesion to a thermal head, as well as thermal-head wear, the following heat-sensitive recording materials have been proposed; a heat-sensitive recording material comprising long-chain alkyl ether-modified polyvinyl alcohol in a protective layer (see Patent Document 1); a heat-sensitive recording material comprising a silicon-modified polymer and inorganic ultra fine particles having a mean primary particle diameter of 0.1 μm or less in a protective layer (see Patent Document 2); a heat-sensitive recording material comprising a silane-modified polymer in a protective layer (see Patent Document 3); a heat-sensitive recording material having a surface roughness (Ra value) of the recorded surface after recording of 0.7 μm or less when recording was conducted with an applied energy of 120 mJ/m$^2$ (see Patent Document 4); a heat-sensitive recording material comprising microparticle-aggregation particles in the outermost layer of the recording side (see Patent Document 5); a heat-sensitive recording material comprising a pigment having a 50% volume average particle diameter of 0.25 to 0.40 μm measured by using a laser diffraction method, and the content of particles having a particle diameter of 1.0 μm or more based on all of the particles being more than 3.0 mass % and 9.0 mass % or less in a protective layer (see Patent Document 6); and a heat-sensitive recording material comprising a protective layer containing a water-soluble resin and calcined clay (namely, calcined kaolin) and formed on a heat-sensitive coloring layer, wherein the calcined clay is present in a proportion of at least 10 mass % of the protective layer to improve chemical resistance and head-matching property (see Patent Document 7). However, heat-sensitive recording materials that possess satisfactory required features have not been obtained yet. Further, a heat-sensitive recording material comprising kaolin having a volume mean particle diameter of 0.8 μm in a protective layer is also known (see Patent Document 8).

Patent Document 1: Japanese Unexamined Patent Publication No. 2000-118133 (Claim 1)

Patent Document 2: Japanese Unexamined Patent Publication No. 2000-118138 (Claim 1)

Patent Document 3: Japanese Unexamined Patent Publication No. 2000-238432 (Claim 1)

Patent Document 4: Japanese Unexamined Patent Publication No. 2000-355165 (Claim 1)

Patent Document 5: Japanese Unexamined Patent Publication No. 2002-086911 (Claim 1)

Patent Document 6: Japanese Unexamined Patent Publication No. 2003-251936 (Claim 1)

Patent Document 7: Japanese Unexamined Patent Publication No. 1990-070483 (Claim 1)

Patent Document 8: International Publication WO2004/024460 (Example 1)

DISCLOSURE OF THE INVENTION

Problems to be Solved by the Invention

In light of problems such as residue adhesion to a thermal head, thermal-head wear, and deterioration of image quality caused by the above problems, an object of the present invention is to provide a transparent heat-sensitive recording material having less residue adhesion to a thermal head and thermal-head wear, even when subjected to recording using especially high heat energy.

Means for Solving the Problem

The present inventors found that the aforementioned objects can be attained by adapting a specific protective layer to a transparent heat-sensitive recording material, and accomplished the present invention.

More specifically, the present invention relates to the following transparent heat-sensitive recording material.

Item 1: A transparent heat-sensitive recording material comprising:

(a) a transparent support;

(b) a heat-sensitive recording layer containing a leuco dye and a developer, and formed on the transparent support; and (c) a protective layer comprising as main components a pigment and a binder and formed on the heat-sensitive recording layer;

the pigment contained in the protective layer being (i) calcined kaolin and at least one main pigment selected from the group consisting of kaolin and aluminum hydroxide, or (ii) calcined kaolin, a third pigment and at least one main pigment selected from the group consisting of kaolin and aluminum hydroxide; and the calcined kaolin being present in a proportion of 0.3 to 5 mass % relative to the protective layer.

Item 2: A transparent heat-sensitive recording material according to Item 1, wherein the total pigment amount is in a proportion of 10 to 30 mass % relative to the protective layer.

Item 3: A transparent heat-sensitive recording material according to Item 1 or 2, wherein the pigment in the protective layer is (i) calcined kaolin and at least one main pigment selected from the group consisting of kaolin and aluminum hydroxide, and the main pigment is present in a proportion of 5 to 29.7 mass % relative to the protective layer.

Item 4: A transparent heat-sensitive recording material according to Item 3, wherein the calcined kaolin is present in a proportion of 0.5 to 3 mass % relative to the protective layer, the main pigment is present in a proportion of 12 to 22.5 mass % relative to the protective layer, and the total pigment amount is 15 to 23 mass % relative to the protective layer.

Item 5: A transparent heat-sensitive recording material according to Item 1 or 2, wherein the pigment contained in the protective layer is (ii) calcined kaolin, a third pigment and at least one main pigment selected from the group consisting of kaolin and aluminum hydroxide, and the total amount of the main pigment and the third pigment is 5 to 29.7 mass % relative to the protective layer.

Item 6: A transparent heat-sensitive recording material according to Item 5, wherein the third pigment is an organic pigment, and said organic pigment is present in a proportion of 10 mass % or less relative to the total amount of the main pigment and the organic pigment.

Item 7: A transparent heat-sensitive recording material according to Item 6, wherein the organic pigment has a volume mean particle diameter of 1 to 2 μm.

Item 8: A transparent heat-sensitive recording material according to Item 5, wherein the third pigment is an organic pigment, the calcined kaolin is present in a proportion of 0.5 to 3 mass % relative to the protective layer, the total amount of the main pigment and the organic pigment is 12 to 22.5 mass % relative to the protective layer, the total pigment amount is 15 to 23 mass % relative to the protective layer, and the organic pigment is present in a proportion of 10 mass % or less relative to the total amount of the main pigment and the organic pigment.

Item 9: A transparent heat-sensitive recording material according to any one of Items 6 to 8, wherein the organic pigment is poly(meth)acrylic acid ester-based resin particles.

Item 10: A transparent heat-sensitive recording material according to any one of Items 1 to 9, wherein said at least one member selected from the group consisting of kaolin and aluminum hydroxide has a volume mean particle diameter of 0.5 to 2.0 μm.

Item 11: A transparent heat-sensitive recording material according to any one of Items 1 to 10, wherein the main pigment is kaolin having a volume mean particle diameter of 1.0 to 2.0 μm.

Item 12: A transparent heat-sensitive recording material according to any one of Items 1 to 11, wherein the calcined kaolin has a volume mean particle diameter of 2.0 to 3.0 μm.

Item 13: A transparent heat-sensitive recording material according to any one of Items 1 to 12, wherein the protective layer is applied in an amount of 0.5 to 10g/m$^2$ on a dry weight basis.

Item 14: A transparent heat-sensitive recording material according to any one of Items 1 to 13, wherein the binder in the protective layer comprises acetoacetyl-modified polyvinyl alcohol and a polyurethane-based resin.

Item 15: A transparent heat-sensitive recording material according to any one of Items 1 to 14, wherein the leuco dye is included in the heat-sensitive recording layer in a form of composite particles containing the leuco dye and a hydrophobic resin.

The present invention relates to a transparent heat-sensitive recording material comprising a transparent support, a heat-sensitive recording layer containing a leuco dye and a developer, and a protective layer containing a pigment and a binder as main components in this order; wherein the protective layer contains calcined kaolin and at least one main pigment selected from the group consisting of kaolin and aluminum hydroxide, and the calcined kaolin is present in a proportion of 0.3 to 5 mass % relative to the protective layer.

Namely, the present invention relates to a transparent heat-sensitive recording material comprising:

(a) a transparent support;

(b) a heat-sensitive recording layer containing a leuco dye and a developer and formed on the transparent support; and (c) a protective layer comprising as main components a pigment and a binder and formed on the heat-sensitive recording layer; calcined kaolin and at least one main pigment selected from the group consisting of kaolin and aluminum hydroxide being included in the protective layer, and the amount of the calcined kaolin being 0.3 to 5 mass % relative to the protective layer.

In other words, the present invention relates to a transparent heat-sensitive recording material comprising:

(a) a transparent support;

(b) a heat-sensitive recording layer, which contains a leuco dye and a developer and, which is formed on the transparent support; and (c) a protective layer, which comprises as main components a pigment and a binder and, which is formed on the heat-sensitive recording layer;

the pigment contained in the protective layer being (i) calcined kaolin and at least one main pigment selected from the group consisting of kaolin and aluminum hydroxide, or (ii) calcined kaolin, a third pigment and at least one main pigment selected from the group consisting of kaolin and aluminum hydroxide; and the calcined kaolin being present in a proportion of 0.3 to 5 mass % relative to the protective layer.

By the above, the remarkable effects of less residue adhesion to a thermal head and less thermal-head wear are obtained while maintaining high transparency, even when recording is carried out using high heat energy.

Protective Layer

The protective layer of the present invention includes a pigment and a binder as main components.

Pigment

The main pigment of the pigment is at least one member selected from the group consisting of kaolin and aluminum hydroxide, and calcined kaolin is further contained as a pigment.

The volume mean particle diameter of one member selected from the group consisting of kaolin and aluminum hydroxide is not limited, but a volume mean particle diameter in the range of 0.5 to 2.0 μm is preferable in terms of transparency. Further, kaolin is more preferable than aluminum hydroxide in terms of transparency. In particular, kaolin having a volume mean particle diameter of 1.0 to 2.0 μm is preferably used, and kaolin having a volume mean particle diameter of 1.3 to 1.9 μm is more preferably used.

Kaolin and aluminum hydroxide having such volume mean particle diameters are obtained by wet-pulverizing commercially available kaolin and aluminum hydroxide using a dispersing agent, such as sodium polyacrylate, using a pulverizer such as a sand mill.

Calcined kaolin having a volume mean particle diameter of 2.0 to 3.0 μm is preferably used together with at least one member selected from the group consisting of kaolin and aluminum hydroxide. This affords high transparency and reduced adhesion of residue to a thermal head.

In the present invention, the volume mean particle diameter of the pigments used in the protective layer is the value determined by using a laser diffraction particle size analyzer SALD2000 (manufactured by SHIMADZU CORPORATION), unless otherwise specified.

The present invention comprises as a support a transparent film and as a pigment calcined kaolin used together with at least one member selected from the group consisting of kaolin and aluminum hydroxide in the protective layer. In the invention, the content (proportion) of calcined kaolin is 0.3 to 5 mass %, preferably 0.5 to 3 mass %, relative to the protective layer.

The use of calcined kaolin in a proportion of less than 0.3 mass % of the protective layer may not achieve an inhibitory effect on residue adhesion to a thermal head, whereas the use of calcined kaolin in a proportion exceeding 5 mass % may cause the transparency (haze value) to deteriorate and bring about thermal-head wear.

The total pigment amount is preferably from 10 to 30 mass %, more preferably from 15 to 25 mass %, and most preferably from 15 to 23 mass %, based on the protective layer. At 10 mass % or higher, the inhibitory effect on residue adhesion to a thermal head can be improved, whereas at 30 mass % or less, transparency can be improved (haze value is reduced) to a preferable range usable in medical diagnosis.

The present invention comprises the specific pigments in the protective layer, but any other pigments (a third pigment) can be used as long as the desired effect of the invention is attained. Examples of such pigments include inorganic pigments, such as calcium carbonate, zinc oxide, aluminum oxide, titanium dioxide, amorphous silica, colloidal silica, barium sulfate, and talc; and organic pigments, such as styrene resin particles, nylon resin particles, poly(meth)acrylic acid ester-based resin particles, and urea/formalin resin particles. Of these pigments, organic pigments are preferable since they improve conveyance during recording on a heat-sensitive recording material with a thermal printer, and reduce the unevenness of high-density colored portions of a heat-sensitive recording material: the phenomenon in which slight convexo-concaves are generated on the surface of a protective layer by coloring a heat-sensitive recording material with high heat energy. Among organic pigments, poly(meth)acrylic acid ester-based resin particles are particularly preferable since they are excellent in reducing the unevenness of high-density colored portions of the heat-sensitive recording material. Further, among inorganic pigments, colloidal silica is preferable for excellent transparency.

When an organic pigment (preferably, poly(meth)acrylic acid ester-based resin particles) is used as a third pigment, the volume mean particle diameter of the organic pigment is preferably from about 1 to about 2 μm. The volume mean particle diameter is the value determined using a laser diffraction particle size analyzer SALD2000 (manufactured by SHIMADZU CORPORATION).

When colloidal silica is used as a third pigment, the proportion of the colloidal silica relative to total amount of the main pigment and the colloidal silica is preferably less than 50 mass % (particularly, 10 to 45 mass %). Colloidal silica having a volume mean particle diameter of about 100 to about 200 nm is preferably used. The volume mean particle diameter of colloidal silica is the value determined using a dynamic light-scattering particle size analyzer LB-500 (manufactured by HORIBA, Ltd.).

When the protective layer comprises a main pigment and calcined kaolin and does not comprise a third pigment, the main pigment is preferably present in a proportion of 5 to 29.7 mass %, (more preferably, 12 to 22.5 mass %), relative to the protective layer. In particular, it is most preferable that calcined kaolin is present in a proportion of 0.5 to 3 mass % relative to the protective layer, that the main pigment is present in a proportion of 12 to 22.5 mass % relative to the protective layer, and that the total pigment amount is 15 to 23 mass % relative to the protective layer.

When the protective layer comprises a main pigment and calcined kaolin and further comprises a third pigment, the total amount of the main pigment and the third pigment is preferably from 5 to 29.7 mass % (more preferably, 12 to 22.5 mass %) relative to the protective layer.

In particular, when the third pigment used is an organic pigment, it is most preferable that calcined kaolin is present in a proportion of 0.5 to 3 mass % relative to the protective layer, that the total amount of the main pigment and the organic pigment is 12 to 22.5 mass % relative to the protective layer, that the total pigment amount is 15 to 23 mass % relative to the protective layer and that the organic pigment is present in a proportion of 10 mass % or less (particularly, 3 to 8 mass %) relative to the total amount of the main pigment and the organic pigment.

When the third pigment used is colloidal silica, it is most preferable that calcined kaolin is present in a proportion of 0.5 to 3 mass % relative to the protective layer, the total amount of the main pigment and the colloidal silica is 12 to 22.5 mass % relative to the protective layer, the total pigment amount is 15 to 23 mass % relative to the protective layer and the proportion of the colloidal silica relative to total amount of the main pigment and colloidal silica is less than 50 mass % (particularly 10 to 45 mass %).

Binder

Examples of binders used in a protective layer include water-soluble resins such as completely saponified or partially saponified polyvinyl alcohols, acetoacetyl-modified polyvinyl alcohol, diacetone-modified polyvinyl alcohol, carboxy-modified polyvinyl alcohol, silicon-modified polyvinyl alcohol, hydroxyethylcellulose, methylcellulose, carboxymethylcellulose, gelatin, casein, alkali salts of styrene-maleic anhydride copolymers, alkali salts of ethylene-acrylic acid copolymers and alkali salts of styrene-acrylic acid copolymers; and hydrophobic resins such as styrene-butadiene-based copolymers, acryl-based copolymers, and polyurethane-based resins, etc. When hydrophobic resins are used as a binder, they may be used in the form of latex. The proportion of the binder used is preferably from 50 to 90 mass %, more preferably from 60 to 85 mass %, relative to the protective layer.

Among them, at least one specific polyvinyl alcohol selected from acetoacetyl-modified polyvinyl alcohol, diacetone-modified polyvinyl alcohol, carboxy-modified polyvinyl alcohol and silicon-modified polyvinyl alcohol is preferable, and acetoacetyl-modified polyvinyl alcohol is particularly preferable. The use of such a specific polyvinyl alcohol and a polyurethane-based resin is particularly preferable, because excellent film-forming properties can be obtained.

Examples of polyurethane-based resins include a polyester polyurethane resin, a polyether polyurethane resin, an aliphatic polyurethane resin, etc having a softening temperature of 80° C. or more. An ionomeric polyurethane resin prepared by incorporating about a few mol % of carboxylate or sulfonate in such polyurethane resin is preferably used.

The ratio of the polyurethane-based resin to the specific polyvinyl alcohol is not particularly limited, but the polyurethane-based resin is typically used in an amount of 10 to 100 mass parts, and preferably 20 to 70 mass parts, per 100 mass parts of the specific polyvinyl alcohol.

Other Components

Further, the protective layer may contain, as other components, lubricants such as alkyl phosphate salts, stearic acid amide, zinc stearate, calcium stearate; cross-linking agents such as boric acid, borax, dialdehyde starch, polyamide epichlorohydrin resin, and adipic acid dihydrazide; surfactants, such as dialkylsulfosuccinate salts, alkylsulfonate salts, alkylcarboxylate salts, and alkylethylene oxides; and fluorine-containing surfactants.

Formation of Protective Layer

The protective layer can be formed by applying over the heat-sensitive recording layer a protective layer coating composition that is obtained by mixing and stirring an aqueous binder, such as, for example, polyvinyl alcohol, a specific pigment of the invention, and, optionally, other pigments, cross-linking agents, lubricants and surfactants, and then drying the coating.

The coating techniques of the protective layer coating composition can be suitably selected from the coating techniques of the heat-sensitive recording layer coating composition mentioned below.

The protective layer coating composition is not particularly limited but applied in an amount of about 0.5 to about 10 $g/m^2$, and preferably from about 2 to about 5 $g/m^2$, on a dry weight basis.

Heat-Sensitive Recording Layer

The heat-sensitive recording layer of the present invention comprises a leuco dye and a developer.

Leuco Dye

Specific examples of the leuco dyes in a heat-sensitive recording layer include red-color-forming leuco dyes such as 3-diethylamino-7-chlorofluoran, 3-(N-ethyl-p-toluidino)-7-methylfluoran, 3-diethylamino-6-methyl-7-chlorofluoran, 3-(N-ethyl-N-isoamyl)amino-7-phenoxyfluoran, 3-diethylamino-6,8-dimethylfluoran, 3-di(n-butyl)amino-6-methyl-7-bromofluoran, 3-tolylamino-7-methylfluoran, 3-tolylamino-7-ethylfluoran, 2-(N-acetylanilino)-3-methyl-6-di(n-butyl)aminofluoran, 2-(N-benzoylanilino)-3-methyl-6-di(n-butyl)aminofluoran, 2-(N-carbobutoxyanilino)-3-methyl-6-di(n-butyl)aminofluoran, 2-(N-methylanilino)-3-methyl-6-di(n-butyl)aminofluoran, etc; blue-color-forming leuco dyes such as 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-(4-diethylamino-2-ethoxyphenyl)-3-(1-ethyl-2-methylindole-3-yl)-4-azaphthalide, 3-diphenylamino-6-diphenylaminofluoran, 3-(2-methyl-1-n-octylindole-3-yl)-3-(4-diethylamino-2-ethoxyphenyl)-4-azaphthalide, etc.; green-color-forming leuco dyes such as 3-(N-ethyl-N-p-tolylamino)-7-(N-phenyl-N-methylamino)fluoran, 3-(N-ethyl-N-n-hexylamino)-7-anilinofluoran, 3-diethylamino-7-dibenzylaminofluoran, 3-diethylamino-7-(o-chloroanilino)fluoran, etc.; yellow-color-forming leuco dyes such as 3,6-dimethoxyfluoran, 1-(4-n-dodecyloxy-3-methoxyphenyl)-2-(2-quinolyl)ethylene, 1,3,3-trimethylindoline-2,2'-spiro-6'-nitro-8'-methoxybenzopyran, etc.; black-color-forming leuco dyes such as 3-pyrrolidino-6-methyl-7-anilinofluoran, 3-diethylamino-7-(m-trifluoromethylanilino)fluoran, 3-(N-isoamyl-N-ethylamino)-7-(o-chloroanilino)fluoran, 3-(N-ethyl-p-toluidino)-6-methyl-7-anilinofluoran, 3-(N-ethyl-N-2-tetrahydrofurfurylamino)-6-methyl-7-anilinofluoran, 3-diethylamino-6-chloro-7-anilinofluoran, 3-di(n-butyl)amino-6-methyl-7-anilinofluoran, 3-di(n-amyl)amino-6-methyl-7-anilinofluoran, 3-(N-isoamyl-N-ethylamino)-6-methyl-7-anilinofluoran, 3-(N-n-hexyl-N-ethylamino)-6-methyl-7-anilinofluoran, 3-di(n-butyl)amino-(2-chloroanilino)fluoran, 3-diethylamino-6-methyl-7-anilinofluoran, 3-diethylamino-6-methyl-7-(3-toluidino)fluoran, 3-diethylamino-6-methyl-7-(2,6-dimethylanilino)fluoran, 3-diethylamino-6-methyl-7-(2,4-dimethylanilino)fluoran, 2,4-dimethyl-6-(4-dimethylaminoanilino) fluoran, etc.; and near-infrared-absorbing leuco dyes having strong absorption wavelengths in the near-infrared region, such as 3,3-bis(4-diethylamino-2-ethoxyphenyl)-4-azaphthalide, 3,3-bis(1-(4-methoxyphenyl)-1-(4-dimethylaminophenyl)ethylene-2-yl)-4,5,6,7-tetrachlorophthalide, 3,6-bis(dimethylamino)fluoren-9-spiro-3'-(6'-dimethylamino)phthalide, 3-(2,2-bis(1-ethyl-2-methylindole-3-yl)vinyl)-3-(4-diethylaminophenyl)phthalide, etc.

When the transparent heat-sensitive recording material of the present invention is used for medical diagnosis using a schaukasten, a combination of two or more black-color-forming leuco dyes can be used, or at least one of red-color-forming leuco dye and near-infrared-absorbing leuco dye can be optionally used together with the black-color-forming leuco dye so as to make the hue of a colored image pure black.

The amount of leuco dye used is not particularly limited, but is preferably from 5 to 30 mass % of the heat-sensitive recording layer.

In the present invention, the leuco dye may be included in the heat-sensitive recording layer in the form of solid fine particles, obtained by wet-pulverizing the leuco dye together with a protective colloidal agent such as polyvinyl alcohol or methylcellulose using a sand mill, or in the form of composite particles containing the leuco dye and a hydrophobic resin.

Embodiments of composite particles comprising a leuco dye and hydrophobic resin include, for example (1) an embodiment in which at least one leuco dye is dissolved in a hydrophobic organic solvent and the resulting solution is microencapsulated with a hydrophobic resin using a method described in Japanese Unexamined Patent Publication No. 1985-244594; (2) an embodiment in which at least one leuco dye is included in a hydrophobic resin matrix using a method described in Japanese Unexamined Patent Publication No. 1997-263057; and (3) an embodiment in which a color formation-controlling layer consisting of a hydrophobic resin is formed on the surface of leuco dye fine particles using a method described in Japanese Unexamined Patent Publication No. 2000-158822. The composite particles preferably have a volume mean particle diameter of about 0.5 to about 3.0 μm, more preferably about 0.5 to about 1.5 μm.

Leuco dyes in the composite particles are highly isolated from outside, and have advantages: suppressing background fogging caused by heat and humidity, and undergoing less color fading in the final recorded image. The composite particles of the above embodiments (1) and (2) are preferable, since they include a leuco dye dissolved in an isocyanate or an organic solvent, and therefore, a highly transparent heat-sensitive recording layer can be obtained compared to the composite particles of embodiment (3) or compared to the case in which leuco dye is used in the form of solid fine particles. Further, the composite particles of embodiment (2) are superior to that of embodiment (1) in that unnecessary coloring is not generated even when pressure is applied to a heat-sensitive recording material.

There is no particular restriction on the hydrophobic resins forming composite particles are usable, and specific examples thereof include urea-based resins, urethane-based resins, urea-urethane-based resins, styrene-based resins, acryl-based resins, etc. Of these, urea-based resins and urea-urethane-based resins are preferable since they impart excellent thermal-background-fogging resistance.

Composite particles including a leuco dye dispersed in a urea-based resin or urea-urethane-based resin are prepared by dissolving a leuco dye in a polyvalent isocyanate compound to produce an oily solution, and emulsifying and dispersing the oily solution in a hydrophilic protective colloid solution such as polyvinyl alcohol so as to produce droplets having a mean particle diameter of about 0.5 to about 3 μm, and then accelerating a polymerization reaction of the polyvalent isocyanate compound.

The polyvalent isocyanate compound is a compound that forms polyurea or polyurea-polyurethane by reacting with water, and may be a single polyvalent isocyanate compound, or a composition of a polyvalent isocyanate compound and a polyol and/or a polyamine that reacts therewith, an adduct of a polyol and a polyvalent isocyanate compound, or multimers such as biuret or isocyanurate adducts of a polyvalent isocyanate compound. A leuco dye is dissolved in such polyvalent isocyanate compound, and the resulting solution is emulsified and dispersed in an aqueous medium containing a protective colloid substance, such as a polyvinyl alcohol, and optionally further mixed with a reactive substance, such as polyamine. Then, the polyvalent isocyanate compound is polymerized by heating the resulting emulsified dispersion, thereby preparing composite particles including a leuco dye and a high-molecular material (hydrophobic resin).

Examples of polyvalent isocyanate compounds include p-phenylenediisocyanate, 2,6-tolylenediisocyanate, 2,4-tolylenediisocyanate, naphthalene-1,4-diisocyanate, dicyclohexylmethane-4,4'-diisocyanate, 1,3-bis(isocyanatomethyl) cyclohexane, 3,3'-dimethyldiphenylmethane-4,4'-diisocyanate, xylylene-1,4-diisocyanate, tetramethylxylylenediisocyanate, 4,4'-diphenylpropanediisocyanate, hexamethylenediisocyanate, butylene-1,2-diisocyanate, cyclohexylene-1,2-diisocyanate, cyclohexylene-1,4-diisocyanate, 4,4',4"-triphenylmethanetriisocyanate, toluene-2,4,6-triisocyanate, a trimethylolpropane adduct of hexamethylenediisocyanate, a trimethylolpropane adduct of 2,4-tolylenediisocyanate, a trimethylolpropane adduct of xylylenediisocyanate, etc.

Further, examples of polyol compounds include ethylene glycol, 1,3-propanediol, 1,4-butanediol, 1,7-heptanediol, 1,8-octanediol, propylene glycol, 1,3-dihydroxybutane, 2,2-dimethyl-1,3-propanediol, 2,5-hexanediol, 3-methyl-1,5-pentanediol, 1,4-cyclohexane dimethanol, dihydroxycyclohexane, diethylene glycol, phenylethylene glycol, pentaerythritol, 1,4-di(2-hydroxyethoxy)benzene, 1,3-di(2-hydroxyethoxy)benzene, p-xylylene glycol, m-xylylene glycol, 4,4'-isopropylidenediphenol, 4,4'-dihydroxydiphenylsulfone, etc.

Examples of polyamine compounds include ethylenediamine, trimethylenediamine, tetramethylenediamine, pentamethylenediamine, hexamethylenediamine, p-phenylenediamine, m-phenylenediamine, 2,5-dimethylpiperazine, triethylenetriamine, triethylenetetramine, diethylaminopropylamine, etc.

Of course, polyvalent isocyanate compounds, adducts of polyvalent isocyanates and polyols, and polyol compounds are not limited to the compounds described above, and at least two of them may be used in combination, as necessary.

Further, a sensitizer and a preservation-improving agent as described below can be included in the composite particles to improve recording sensitivity and preservation stability of recorded images.

The proportion of composite particles in the heat-sensitive recording layer is preferably from about 10 to about 60 mass %, and more preferably from about 20 to about 50 mass % of the heat-sensitive recording layer.

The content of the leuco dye in the composite particles is preferably from about 10 to about 90 mass %, more preferably from about 35 to about 60 mass %.

Developer

Examples of developers included in the heat-sensitive recording layer together with a leuco dye include 4,4'-isopropylidenediphenol, 4,4'-cyclohexylidenediphenol, 2,2'-bis(4-hydroxy-3-methylphenyl)propane, 2,2-bis(4-hydroxyphenyl)-4-methylpentane, 2,4'-dihydroxydiphenylsulfone, 4,4'-dihydroxydiphenylsulfone, 4-hydroxy-4'-isopropoxydiphenylsulfone, bis(3-allyl-4-hydroxyphenyl) sulfone, 4-hydroxy-4'-allyloxydiphenylsulfone, 4-hydroxy-4'-methyldiphenylsulfone, butyl bis(p-hydroxyphenyl) acetate, methyl bis(p-hydroxyphenyl)acetate, 1,1-bis(4-hydroxyphenyl)-1-phenylethane, 1,4-bis(α-methyl-α-(4'-hydroxyphenyl)ethyl)benzene, and like phenolic compounds; N-(p-tolylsulfonyl)-N'-phenylurea, 4,4'-bis(N-p-tolylsulfonylaminocarbonylamino)diphenylmethane, 4,4'-bis((4-methyl-3-phenoxycarbonylaminophenyl)ureido) diphenylsulfone, N-p-tolylsulfonyl-N'-p-butoxyphenylurea and like compounds having sulfonyl group(s) and/or ureido group(s); zinc 4-(n-octyloxycarbonylamino)salicylate, zinc 4-(2-(p-methoxyphenoxy)ethyloxy)salicylate, zinc 4-(3-(p-tolylsulfonyl)propyloxy)salicylate, 5-(p-(2-p-methoxyphenoxyethoxy)cumyl)salicic acid and like zinc-salt compounds of aromatic carboxylic acid; etc.

These developers are pulverized using a pulverizer, such as a sand mill or an ultravisco mill to a mean particle diameter of about 0.1 to about 0.5 μm, preferably about 0.1 to about 0.3 μm using water as a dispersion medium, and using polyvinyl alcohols such as sulfone-modified polyvinyl alcohol, and cellulose such as methylcellulose and hydroxypropylmethylcellulose as a protective colloidal agent.

A developer is preferably used from about 1 to about 7 mass parts, more preferably from about 2 to about 5 mass parts, per mass part of the leuco dye.

Other Components

Further, a preservation-improving agent for improving preservation stability of recorded images, and a sensitizer for improving recording sensitivity can be included in the heat-sensitive recording layer.

Examples of preservation-improving agents include 4,4'-butylidenebis(6-tert-butyl-3-methylphenol), 2,2'-methylenebis(4-ethyl-6-tert-butylphenol), 2,4-di(tert-butyl)-3-methylphenol, 1,1,3-tris(2-methyl-4-hydroxy-5-tert-buthylphenyl)butane, 1,1,3-tris(2-methyl-4-hydroxy-5-cyclohexylphenyl)butane, 1,3,5-tris(5-tert-butyl-3-hydroxy-2,6-dimethylbenzyl)isocyanuric acid, and like hindered phenols; 4-(2-methyl-1,2-epoxyethyl)diphenylsulfone, 4-(2-ethyl-1,2-epoxyethyl)diphenylsulfone, 4-benzyloxy-4'-(2,3-glycidyloxy)diphenylsulfone, and like diphenylsulfone-based epoxy compounds; 2-(2'-hydroxy-5'-methylphenyl)

benzotriazole, 2-(3'-tert-butyl-5'-methyl-2'-hydroxyphenyl)-5-chlorobenzotriazole, 2-hydroxy-4-benzyloxybenzophenone, 2-hydroxy-4-octyloxybenzophenone, and like UV absorbers.

Examples of sensitizers include stearic acid amide, stearic acid methylene bisamide, stearic acid ethylene bisamide, p-benzylbiphenyl, 1,2-diphenoxyethane, 1,2-di(3-methylphenoxy)ethane, 1-(2-methylphenoxy)-2-(4-methoxyphenoxy)ethane, naphthyl benzyl ether, m-terphenyl, benzyl-4-methylthiophenyl ether, dibenzyl oxalate, di-p-methylbenzyl oxalate, di-p-chlorobenzyl oxalate, dibutyl terephthalate, dibenzyl terephthalate, 1-hydroxynaphthoic acid phenyl ester, benzyl 4-methylthiophenyl ether, etc.

Formation of Heat-Sensitive Recording Layer

The heat-sensitive recording layer is typically prepared by applying a heat-sensitive recording layer coating composition to a transparent support in an amount of about 3 to about 30 g/m$^2$, particularly about 5 to about 28 g/m$^2$, on a dry-weight basis, the heat-sensitive recording layer coating composition being prepared by mixing a lueco dye, a developer, a binder, and if desired, a preservation-improving agent, a sensitizer, and an auxiliary described below using water as dispersion medium.

Examples of binders include oxidized starch, hydroxymethylcellulose, hydroxypropylcellulose, methylcellulose, polyvinyl alcohol, carboxy-modified polyvinyl alcohol, silicon-modified polyvinyl alcohol, styrene-maleic anhydride copolymer, isobutylene-maleic anhydride copolymer, casein, and like water-soluble binders; and polyester-based resins, polyvinyl acetate-based resins, polyurethane-based resins, polyacrylic-based resins, styrene-butadiene-based copolymer resins, hybrid styrene-butadiene copolymer resins obtained via the copolymerization of a styrene monomer and a butadiene monomer in an aqueous medium containing polyurethane ionomer, and like hydrophobic binder.

The content of the binder used is not particularly limited, but is from about 5 to about 40 mass %, and preferably from about 15 to about 38 mass %, of the heat-sensitive recording layer. When the medium of the heat-sensitive recording layer coating composition is water, hydrophobic binders are used in the form of latex.

Examples of auxiliaries include, for example, sodium dioctylsulfosuccinate, sodium dodecylbenzene sulphonate, sodium lauryl sulfate, fatty acid metal salts and like surfactants; zinc stearate, calcium stearate and like lubricants; polyethylene wax, carnauba wax, paraffin wax, ester wax and like waxes; kaolin, clay, talc, calcium carbonate, calcined kaolin, titanium oxide, amorphous silica, aluminum hydroxide, and like pigments; as well as anti-foaming agents, fluorescent whitening dyes, cross-linking agents, etc.

The heat-sensitive recording layer coating composition can be applied by a coating technique such as, for example, air-knife coating, rod blade coating, bar coating, vari-bar blade coating, pure blade coating, short-dwell coating, curtain coating, slot die coating, or die coating.

A heat-sensitive recording layer coating composition may be applied in such a manner that two or more layers of the same composition may be formed or a laminate of two or more layers of different compositions may be formed.

Transparent Support

There is no particular restriction on the transparent support on which a heat-sensitive recording layer can be formed, but a polyethylene terephthalate film, which is heat-resistant, is preferable as the transparent heat-sensitive recording material for medical use, wherein high-energy recording is required. The film thickness may be in the range of about 20 to about 200 μm, and the film may be colored blue. In order to increase high adhesion to a heat-sensitive recording layer, the transparent support may be provided with an anchor coat layer on the surface, or may be subjected to corona discharge treatment before a heat-sensitive recording layer coating composition is applied. Further, conduction treatment may be applied by using a conductive agent. In order to improve the runnability of the transparent heat-sensitive recording material, a back layer containing a pigment such as resin particles and a binder can be formed on the back surface of a support.

EFFECTS OF THE INVENTION

A transparent heat-sensitive recording material of the present invention has the remarkable effects of less residue adhesion to a thermal head and less thermal-head wear, even when recording is carried out with high heat energy.

BEST MODE FOR CARRYING OUT THE INVENTION

The heat-sensitive recording material of the present invention will be described in more detail below by way of Examples, which are not intended to limit the invention. In the Examples, "parts" and "%" represent "parts by mass" and "percent by mass", respectively, unless otherwise specified. The volume mean particle diameters of composite particles and pigments added to a protective layer of the invention were measured using a laser diffraction particle size analyzer SALD2000 (manufactured by SHIMADZU CORPORATION). The mean particle diameter of the developer was measured using a dynamic light-scattering particle size analyzer LB-500 (manufactured by HORIBA, Ltd.).

Example 1

Preparation of Dispersion A (Composite Particle Dispersion)

Five parts of 3-di(n-butyl)amino-6-methyl-7-anilinofluoran, 5 parts of 3-diethylamino-6-methyl-7-(3-toluidino)fluoran, 6 parts of 3-diethylamino-6,8-dimethylfluoran and 2 parts of 3,3-bis(4-diethylamino-2-ethoxyphenyl)-4-azaphthalide, as a leuco dye, and 8 parts of 2-hydroxy-4-octyloxybenzophenone were dissolved while heating (150° C.) in a mixed solvent composed of 5 parts of dicyclohexylmethane-4,4'-diisocyanate (product of Sumitomo Bayer Urethane Co., Ltd.: Desmodur W) and 15 parts of m-tetramethylxylylenediisocyanate (product of Mitsui Takeda Chemicals Inc.: Takenate (registered trademark) TMXDI). The resulting solution was gradually added to 100 parts of an aqueous solution including 8.5 parts of polyvinyl alcohol (product of Kuraray Co., Ltd.: Poval (registered trademark) PVA-217EE) and 0.5 part of the ethylene oxide adduct of an acetylene glycol (product of Nissin Chemical Industry Co., Ltd.: Olfine E1010) as a surfactant. The mixture obtained was then emulsified and dispersed by agitation using a homogenizer at a speed of 10000 rpm. To the emulsified dispersion were added 30 parts of water and 3 parts of a polyvalent amine compound (product of Shell International Petroleum Co.: Epicure (registered trademark) T) in 22 parts of water. The resulting emulsified dispersion was heated to 75° C. and a polymerization reaction was carried out for 7 hours to prepare a dispersion of leuco dye-containing composite particles having a volume mean particle diameter of 0.8 μm. The resulting dispersion was diluted with water to obtain a leuco dye-containing composite particle dispersion having a dry solids content of 25%.

Preparation of Dispersion B (Developer Dispersion)

A composition comprising 42 parts of zinc 4-(n-octyloxycarbonylamino)salicylate, 60 parts of a 10% aqueous solution of sulfone-modified polyvinyl alcohol, and 18 parts of water was pulverized using an ultravisco mill to a mean particle diameter of 0.3 μm, thus giving a developer dispersion.

Preparation of Dispersion C (Developer Dispersion)

A composition comprising 42 parts of 2,2'-bis(4-hydroxy-3-methylphenyl)propane, 60 parts of a 10% aqueous solution of sulfone-modified polyvinyl alcohol, and 18 parts of water was pulverized using an ultravisco mill to a mean particle diameter of 0.3 μm, thus giving a developer dispersion.

Preparation of Heat-Sensitive Recording Layer Coating Composition

A composition comprising 144 parts of Dispersion A, 59 parts of Dispersion B, 41 parts of Dispersion C, 62 parts of a styrene-butadiene-based latex having a solids content of 45% (tradename: L-1571, product of Asahi Kasei Corporation), and 60 parts of water was stirred to give a heat-sensitive recording layer coating composition.

Preparation of Dispersion D (Kaolin Dispersion)

Eighty parts of kaolin (UW-90, product of Engelhard Corporation), 1 part of a 40% aqueous solution of sodium polyacrylate (ARON A-9, product of Toagosei, Co., Ltd.), and 53 parts of water were pulverized using a sand mill to a volume mean particle diameter of 1.6 μm, thus giving a kaolin dispersion.

Preparation of Protective Layer Coating Composition

A protective layer coating composition was prepared by stirring a composition comprising 100 parts of ionomeric polyurethane-based resin latex (product of Dainippon Ink & Chemicals, Inc., Hydran (registered trademark) AP-30F, solids content: 20%), 650 parts of a 8% aqueous solution of acetoacetyl-modified polyvinyl alcohol (product of Nippon Synthetic Chemical Industry Co., Ltd., GOHSEFIMER (registered trademark) Z-410, polymerization degree: about 2300, saponification degree: about 98 mol %), 5 parts of a 25% aqueous solution of polyamideamine/epichlorohydrin, 28 parts of Dispersion D, 1.5 parts of calcined kaolin having a volume mean particle diameter of 2.5 μm (Ansilex 93, product of Engelhard Corporation), 18 parts of stearic acid amide (product of Chukyo Yushi Co., Ltd., Hymicron L-271, solids content: 25%), 3 parts of stearyl phosphate potassium salt (product of Matsumoto Yushi-Seiyaku Co., Ltd, Woopol 1800, solids content: 35%), 6 parts of a 10% aqueous solution of perfluoroalkyl ethylene oxide adduct (product of Seimi Chemical, Co., Ltd., Surflon (registered trademark) S-145), and 490 parts of water.

Formation of Transparent Heat-Sensitive Recording Material

The foregoing heat-sensitive recording layer coating composition was applied to one side of a transparent polyethylene terephthalate film that was colored blue (product of Teijin DuPont Films Japan Limited., Melinex (registered trademark) 912, thickness: 175 μm), using a slot die coater in an amount of 20 g/m$^2$ on a dry weight basis and dried, thus giving a heat-sensitive recording layer, and the foregoing protective layer coating composition was applied thereon using a slot die coater in an amount of 3.5 g/m$^2$ on a dry weight basis and dried to give a protective layer, thus giving a transparent heat-sensitive recording material.

Example 2

A transparent heat-sensitive recording material was prepared in the same manner as in Example 1, except that in preparing the protective layer coating composition of Example 1, the amount of calcined kaolin (Ansilex 93, product of Engelhard Corporation) was reduced from 1.5 parts to 0.5 part.

Example 3

A transparent heat-sensitive recording material was prepared in the same manner as in Example 1, except that in preparing the protective layer coating composition of Example 1, the amount of calcined kaolin (Ansilex 93, product of Engelhard corporation) was increased from 1.5 parts to 3.0 parts.

Example 4

Preparation of Dispersion E (Aluminum Hydroxide Dispersion)

80 parts of aluminum hydroxide (Higilite H-42, product of Showa Light Metal Co., Ltd.), 1 part of a 40% aqueous solution of sodium polyacrylate (ARON A-9, product of Toagosei Co., Ltd.), and 53 parts of water were pulverized using a sand mill to a volume mean particle diameter of 0.8 μm, thus giving an aluminum hydroxide dispersion.

A transparent heat-sensitive recording material was prepared in the same manner as in Example 1, except that in preparing the protective layer coating composition of Example 1, 28 parts of Dispersion E was used instead of 28 parts of Dispersion D.

Example 5

Preparation of Dispersion F (Mixed Developers Dispersion)

A composition comprising 23 parts of 4,4'-cyclohexylidenediphenol, 14 parts of 4,4'-bis(N-p-tolyl sulfonylaminocarbonylamino)diphenylmethane, 5 parts of 4-hydroxy-4'-allyloxydiphenylsulfone, 60 parts of a 10% aqueous solution of sulfone-modified polyvinyl alcohol, and 18 parts of water was pulverized using an ultravisco mill to a mean particle diameter of 0.28 μm, thus giving a mixed developers dispersion.

Preparation of Dispersion G (Developer Dispersion)

A composition comprising 42 parts of N-(p-tolyl sulfonyl)-N1-phenylurea, 60 parts of a 10% aqueous solution of sulfone-modified polyvinyl alcohol, and 18 parts of water was pulverized using an ultravisco mill to a mean particle diameter of 0.30 μm, thus giving a developer dispersion.

Preparation of Heat-Sensitive Recording Layer Coating Composition

A composition comprising 88 parts of Dispersion A, 100 parts of Dispersion F, 20 parts of Dispersion G, 76 parts of a hybrid resin of a polyurethane-based ionomer and a styrene-butadiene-based resin having a solids content of 41% (latex prepared by copolymerizing styrene monomer and butadiene monomer in an aqueous medium containing polyurethane ionomer: PATELACOL H2090, product of Dainippon Ink & Chemicals, Inc.), 10 parts of an aqueous solution of sodium dioctylsulfosuccinate (SN wet OT-70, product of San Nopco Limited.) having a solids content of 10%, and 55 parts of water was mixed and stirred to obtain a heat-sensitive recording layer coating composition.

Formation of Transparent Heat-Sensitive Recording Material

A transparent heat-sensitive recording material was prepared in the same manner as in Example 1, except that the heat-sensitive recording layer coating composition obtained above was used.

Example 6

A transparent heat-sensitive recording material was prepared in the same manner as in Example 5, except that the protective layer coating composition used in Example 4 was used.

Example 7

Preparation of Protective Layer Coating Composition

A protective layer coating composition was prepared in the same manner as in Example 1, except that the amount of calcined kaolin (Ansilex 93, product of Engelhard Corporation) was increased from 1.5 parts to 2.8 parts, and the amount of Dispersion D (Kaolin dispersion) was reduced from 28 parts to 19 parts.

Formation of Transparent Heat-Sensitive Recording Material

A transparent heat-sensitive recording material was prepared in the same manner as in Example 5, except that the protective layer coating composition obtained above was used.

Example 8

Preparation of Protective Layer Coating Composition

A protective layer coating composition was prepared in the same manner as in Example 1, except that the amount of calcined kaolin (Ansilex 93, product of Engelhard Corporation) was reduced from 1.5 parts to 1.0 part, and the amount of Dispersion D (Kaolin dispersion) was increased from 28 parts to 38 parts.

Formation of Transparent Heat-Sensitive Recording Material

A transparent heat-sensitive recording material was prepared in the same manner as in Example 5, except that the protective layer coating composition obtained above was used.

Example 9

Preparation of Dispersion H (Composite Particle Dispersion)

A dispersion of leuco dye-containing composite particles having a volume mean particle diameter of 0.8 μm was prepared in the same manner as in Example 1, except that in preparing Dispersion A, 6 parts of 2-hydroxy-4-octyloxy benzophenone, and 2 parts of 2-(3'-tert-butyl-5'-methyl-2'-hydroxyphenyl)-5-chlorobenzotriazole were used instead of 8 parts of 2-hydroxy-4-octyloxybenzophenone. The resulting dispersion was diluted with water to obtain a leuco dye-containing composite particle dispersion having a dry solids content of 25%.

Preparation of Heat-Sensitive Recording Layer Coating Composition

A heat-sensitive recording layer coating composition was prepared in the same manner as in Example 5, except that 88 parts of Dispersion H was used instead of 88 parts of Dispersion A.

Preparation of Protective Layer Coating Composition

A protective layer coating composition was prepared in the same manner as in Example 1, except that 1 part of poly(meth)acrylic acid ester-based resin particles (product of Soken Chemical & Engineering Co., Ltd.: MX-150, volume mean particle diameter: 1.4 μm) were further added.

Formation of Transparent Heat-Sensitive Recording Material

A transparent heat-sensitive recording material was prepared in the same manner as in Example 5, except that the heat-sensitive recording layer coating composition and protective layer coating composition obtained above were used.

Example 10

Preparation of Protective Layer Coating Composition

A protective layer coating composition was prepared in the same manner as in Example 1, except that the amount of calcined kaolin (Ansilex 93, product of Engelhard Corporation) was increased from 1.5 parts to 2.8 parts, the amount of Dispersion D (Kaolin dispersion) was reduced from 28 parts to 18 parts, and 0.8 parts of poly(meth)acrylic acid ester-based resin particles (product of Soken Chemical & Engineering Co., Ltd.: MX-150) were further added.

Formation of Transparent Heat-Sensitive Recording Material

A transparent heat-sensitive recording material was prepared in the same manner as in Example 9, except that the protective layer coating composition obtained above was used.

Example 11

Preparation of Protective Layer Coating Composition

A protective layer coating composition was prepared in the same manner as in Example 1, except that the amount of calcined kaolin (Ansilex 93, product of Engelhard Corporation) was reduced from 1.5 parts to 1.0 part, the amount of Dispersion D (Kaolin dispersion) was increased from 28 parts to 36 parts, and 1 part of poly(meth)acrylic acid ester-based resin particles (product of Soken Chemical & Engineering Co., Ltd.: MX-150) were further added.

Formation of Transparent Heat-Sensitive Recording Material

A transparent heat-sensitive recording material was prepared in the same manner as in Example 9, except that the protective layer coating composition obtained above was used.

Example 12

Preparation of Protective Layer Coating Composition

A protective layer coating composition was prepared in the same manner as in Example 1, except that the amount of calcined kaolin (Ansilex 93, product of Engelhard Corporation) was reduced from 1.5 parts to 0.6 part, the amount of Dispersion D (Kaolin dispersion) was increased from 28 parts to 35 parts, and 1 part of poly(meth)acrylic acid ester-based resin particles (product of Soken Chemical & Engineering Co., Ltd.: MX-150) were further added.

Formation of Transparent Heat-Sensitive Recording Material

A transparent heat-sensitive recording material was prepared in the same manner as in Example 9, except that the protective layer coating composition obtained above was used.

Comparative Example 1

A transparent heat-sensitive recording material was prepared in the same manner as in Example 1, except that in preparing the protective layer coating composition of Example 1, the amount of calcined kaolin (Ansilex 93, product of Engelhard corporation) was reduced from 1.5 parts to 0.1 part.

Comparative Example 2

A transparent heat-sensitive recording material was prepared in the same manner as in Example 1, except that in preparing the protective layer coating composition of Example 1, the amount of calcined kaolin (Ansilex 93, product of Engelhard Corporation) was increased from 1.5 parts to 7.0 parts.

Comparative Example 3

A transparent heat-sensitive recording material was prepared in the same manner as in Example 1, except that in preparing the protective layer coating composition of Example 1, calcined kaolin was not used and the amount of Dispersion D was increased from 28 parts to 40 parts.

The transparent heat-sensitive recording materials thus obtained were evaluated for the following characteristics. The results are shown in Table 1.

Haze Value

The haze value of the transparent heat-sensitive recording material was measured using a haze meter (TC-H IV, product of Tokyo Denshoku Co., Ltd.).

Residue Adhesion Test A

The recording of CT images on 5000 sheets (17 inch×14 inch/per each) of a transparent heat-sensitive recording material was conducted using a thermal printer (UP-DF500, product of Sony Corporation) as a recording device, and then the condition of the thermal head of the recording device was observed using a digital microscope (VH-7000, product of KEYENCE CORPORATION) and evaluated in accordance with the following evaluation criteria.

Evaluation Criteria

1. Residue adhesion to the thermal head was scarcely observable.
2. Residue adhesion to the thermal head was partly observable, and recording problems would have been generated if recording had continued.
3: Observable residue adhesion to the thermal head, resulting in recording problems.

Residue Adhesion Test B

The Residue Adhesion Test B was conducted in the same manner as in Residue Adhesion Test A, except that the number of sheets on which CT images were recorded was changed from 5000 sheets to 10000 sheets.

Thermal-Head Wear Test

After Residue Adhesion Test A, CT images were repeatedly recorded on 5000 sheets of each heat-sensitive recording material (a total of 10000 sheets, including the sheets used in Residue Adhesion Test A), and occurrence of recording problems caused by thermal-head wear was evaluated in accordance with the following evaluation criteria.

Evaluation Criteria

1: Free of recording problems caused by thermal-head wear
2: Slight recording problems caused by thermal-head wear were observed.
3: Recording problems had occurred as a result of thermal-head wear at the time of residue adhesion testing (5000-sheet recording).

Uneveness of High-Density Colored Portions

The gloss of high-density colored portions and gloss of low-density colored portions were observed visually and rated for unevenness of high-density colored portion.

Evaluation Criteria

1: The gloss of high-density colored portions and that of low-density colored portions are the same, and the surface of recorded portions was not roughened.
2: The gloss of high-density colored portions was lower than that of low-density colored portions, and the surface of recorded portions was roughened, but there were no practical problems.

TABLE 1

| | Calcined Kaolin | Main Pigment | | Third Pigment | | Total | Residue Adhesion Tests | | Haze | Thermal-Head | Uneveness of High-Density |
|---|---|---|---|---|---|---|---|---|---|---|---|
| | Content (%) | Kind | Content (%) | Kind | Content (%) | Pigment Content | A | B | Value (%) | Wear Test | Colored Portions |
| Ex. 1 | 1.5 | Kaolin | 17.1 | — | — | 18.6 | 1 | 1 | 43.1 | 1 | 2 |
| Ex. 2 | 0.5 | Kaolin | 17.3 | — | — | 17.8 | 1 | 1 | 38.5 | 1 | 2 |
| Ex. 3 | 3.0 | Kaolin | 16.8 | — | — | 19.8 | 1 | 1 | 44.9 | 1 | 2 |
| Ex. 4 | 1.5 | Aluminum Hydroxide | 17.1 | — | — | 18.6 | 1 | 1 | 49.2 | 1 | 2 |
| Ex. 5 | 1.5 | Kaolin | 17.1 | — | — | 18.6 | 1 | 1 | 30.0 | 1 | 2 |
| Ex. 6 | 1.5 | Aluminum Hydroxide | 17.1 | — | — | 18.6 | 1 | 1 | 37.7 | 1 | 2 |
| Ex. 7 | 3.0 | Kaolin | 12.1 | — | — | 15.1 | 1 | 1 | 30.9 | 1 | 2 |
| Ex. 8 | 1.0 | Kaolin | 22.0 | — | — | 23.0 | 1 | 1 | 31.6 | 1 | 2 |
| Ex. 9 | 1.5 | Kaolin | 16.9 | PMMA* | 1.0 | 19.4 | 1 | 1 | 30.1 | 1 | 1 |
| Ex. 10 | 3.0 | Kaolin | 11.4 | PMMA* | 0.9 | 15.3 | 1 | 1 | 31.1 | 1 | 1 |
| Ex. 11 | 1.0 | Kaolin | 20.9 | PMMA* | 1.0 | 22.9 | 1 | 1 | 31.8 | 1 | 1 |
| Ex. 12 | 0.6 | Kaolin | 20.5 | PMMA* | 1.0 | 22.1 | 1 | 1 | 27.7 | 1 | 1 |
| Comp. Ex. 1 | 0.1 | Kaolin | 17.3 | — | — | 17.4 | 2 | 3 | 36.4 | 1 | 2 |

TABLE 1-continued

| | Calcined Kaolin Content (%) | Main Pigment Kind | Main Pigment Content (%) | Third Pigment Kind | Third Pigment Content (%) | Total Pigment Content | Residue Adhesion Tests A | Residue Adhesion Tests B | Haze Value (%) | Thermal-Head Wear Test | Uneveness of High-Density Colored Portions |
|---|---|---|---|---|---|---|---|---|---|---|---|
| Comp. Ex. 2 | 6.8 | Kaolin | 16.2 | — | — | 23.0 | 1 | — | 55.8 | 3 | 2 |
| Comp. Ex. 3 | — | Kaolin | 23.1 | — | — | 23.1 | 3 | 3 | 36.1 | 1 | 2 |

*poly(meth)acrylic acid ester-based resin particles

INDUSTRIAL APPLICABILITY

In a transparent heat-sensitive recording material of the invention comprising, in order, a transparent support, a heat-sensitive recording layer containing a leuco dye and a developer, and a protective layer containing a pigment and a binder as main components, when at least one member selected from the group consisting of kaolin and aluminum hydroxide is used as the main pigment and calcined kaolin is further used as an additional pigment in the protective layer, wherein the calcined kaolin is used in a proportion of 0.3 to 5 mass % relative to the protective layer, an excellent transparent heat-sensitive recording material which has less residue adhesion to a thermal head and less thermal-head wear is produced even when recording is carried out using high heat energy and the invention is applicable to a transparent heat-sensitive recording material for medical use.

The invention claimed is:

1. A transparent heat-sensitive recording material comprising:

(a) a transparent support;

(b) a heat-sensitive recording layer containing a leuco dye and a developer and provided on the transparent support; and (c) a protective layer comprising as main components a pigment and a binder and provided on the heat-sensitive recording layer;

the binder in the protective layer comprising acetoacetyl-modified polyvinyl alcohol and a polyurethane-based resin; and the pigment contained in the protective layer being (I) calcined kaolin and at least one main pigment selected from the group consisting of kaolin and aluminum hydroxide, or (ii) calcined kaolin, a third pigment, and at least one main pigment selected from the group consisting of kaolin and aluminum hydroxide; and the calcined kaolin being present in a proportion of 0.3 to 5 mass % relative to the protective layer.

2. A transparent heat-sensitive recording material according to claim 1, wherein the total pigment amount is in a proportion of 10 to 30 mass % relative to the protective layer.

3. A transparent heat-sensitive recording material according to claim 1, wherein the pigment in the protective layer is (I) calcined kaolin and at least one main pigment selected from the group consisting of kaolin and aluminum hydroxide; and the main pigment is present in a proportion of 5 to 29.7 mass % relative to the protective layer.

4. A transparent heat-sensitive recording material according to claim 3, wherein the calcined kaolin is present in a proportion of 0.5 to 3 mass % relative to the protective layer, and the main pigment is present in a proportion of 12 to 22.5 mass % relative to the protective layer, and the total pigment amount is 15 to 23 mass % relative to the protective layer.

5. A transparent heat-sensitive recording material according to claim 1, wherein the pigment in the protective layer is (ii) calcined kaolin, a third pigment and at least one main pigment selected from the group consisting of kaolin and aluminum hydroxide; and the total amount of the main pigment and the third pigment is 5 to 29.7 mass % relative to the protective layer.

6. A transparent heat-sensitive recording material according to claim 5, wherein the third pigment is an organic pigment, and said organic pigment is present in a proportion of 10 mass % or less relative to the total amount of the main pigment and the organic pigment.

7. A transparent heat-sensitive recording material according to claim 6, wherein the organic pigment has a volume mean particle diameter of 1 to 2 μm.

8. A transparent heat-sensitive recording material according to claim 7, wherein the organic pigment is poly(meth) acrylic acid ester-based resin particles.

9. A transparent heat-sensitive recording material according to claim 6, wherein the organic pigment is poly(meth) acrylic acid ester-based resin particles.

10. A transparent heat-sensitive recording material according to claim 5, wherein the third pigment is an organic pigment, calcined kaolin is present in a proportion of 0.5 to 3 mass % relative to the protective layer, the total amount of the main pigment and the organic pigment is 12 to 22.5 mass % relative to the protective layer, the total pigment amount is 15 to 23 mass % relative to the protective layer, and the organic pigment is present in a proportion of 10 mass % or less relative to the total amount of the main pigment and the organic pigment.

11. A transparent heat-sensitive recording material according to claim 10, wherein the organic pigment is poly(meth) acrylic acid ester-based resin particles.

12. A transparent heat-sensitive recording material according to claim 1, wherein said at least one member selected from the group consisting of kaolin and aluminum hydroxide has a volume mean particle diameter of 0.5 to 2.0 μm.

13. A transparent heat-sensitive recording material according to claim 1, wherein the main pigment is kaolin having a volume mean particle diameter of 1.0 to 2.0 μm.

14. A transparent heat-sensitive recording material according to claim 1, wherein the calcined kaolin has a volume mean particle diameter of 2.0 to 3.0 μm.

15. A transparent heat-sensitive recording material according to claim 1, wherein the protective layer is applied in an amount of 0.5 to 10g/m$^2$ on a dry weight basis.

16. A transparent heat-sensitive recording material according to claim 1, wherein the leuco dye is included in the heat-sensitive recording layer in the form of composite particles containing the leuco dye and a hydrophobic resin.

* * * * *